US006831606B2

(12) United States Patent
Sajadinia

(10) Patent No.: US 6,831,606 B2
(45) Date of Patent: Dec. 14, 2004

(54) ANTENNA DEVICE AND A METHOD FOR MANUFACTURING AN ANTENNA DEVICE

(75) Inventor: Hamid Sajadinia, Stockholm (SE)

(73) Assignee: AMC Centurion AB, Akersberga (SE)

( * ) Notice: Subject to any disclaimer, the term of this patent is extended or adjusted under 35 U.S.C. 154(b) by 0 days.

(21) Appl. No.: 10/169,914

(22) PCT Filed: Jan. 26, 2001

(86) PCT No.: PCT/SE01/00157

§ 371 (c)(1),
(2), (4) Date: Oct. 23, 2002

(87) PCT Pub. No.: WO01/57951

PCT Pub. Date: Aug. 9, 2001

(65) Prior Publication Data

US 2003/0090421 A1 May 15, 2003

(30) Foreign Application Priority Data

Jan. 31, 2000 (SE) ..... 0000290

(51) Int. Cl.[7] ..... H01Q 1/38
(52) U.S. Cl. ..... 343/700 MS; 343/895

(58) Field of Search ..... 343/700 MS, 702, 343/895

(56) References Cited

U.S. PATENT DOCUMENTS

| | | | | |
|---|---|---|---|---|
| 4,255,752 A | | 3/1981 | Noble et al. | 343/771 |
| H001460 H | * | 7/1995 | Davis | 343/700 MS |
| 5,757,334 A | | 5/1998 | Cobb | 343/873 |
| 6,107,920 A | * | 8/2000 | Eberhardt et al. | 340/572.7 |
| 6,285,342 B1 | * | 9/2001 | Brady et al. | 343/895 |

FOREIGN PATENT DOCUMENTS

DE 146873 3/1981

* cited by examiner

*Primary Examiner*—Shih-Chao Chen
(74) *Attorney, Agent, or Firm*—Jacobson Holman PLLC

(57) ABSTRACT

The present invention relates to an antenna device (20, 30) comprising a conductive pattern (22, 31). The conductive pattern is made of a metal having good conductibility, e.g. copper, copper alloy or silver polymer, and is provided with at least one contact portion (24, 34). The conductive pattern (22, 31) is at least partially coated with a graphite compound, preferably pure graphite. The invention also relates to a manufacturing method for an antenna device.

14 Claims, 4 Drawing Sheets

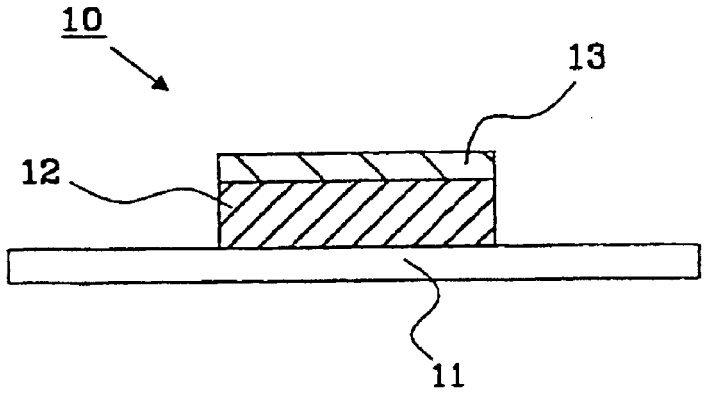
FIG. 1
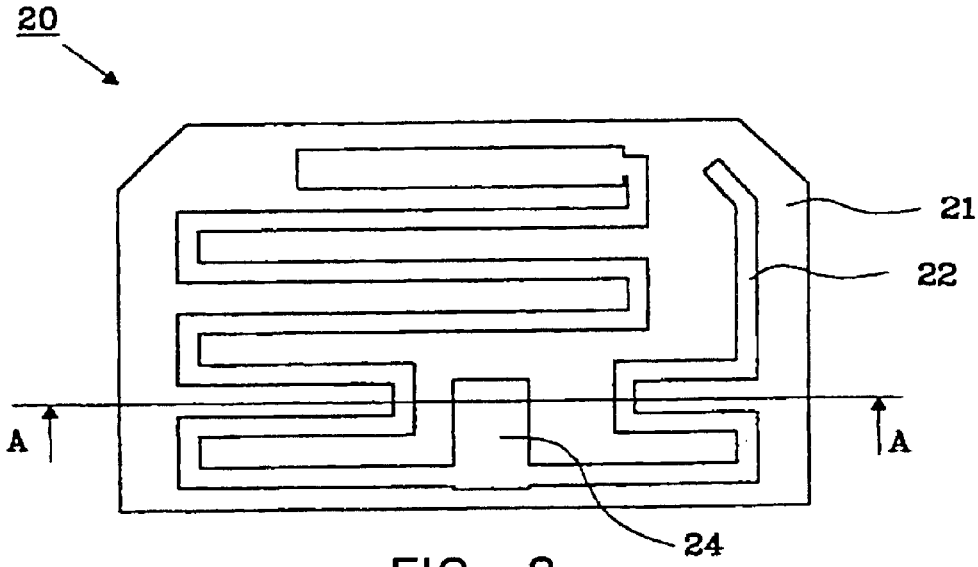
FIG. 2a
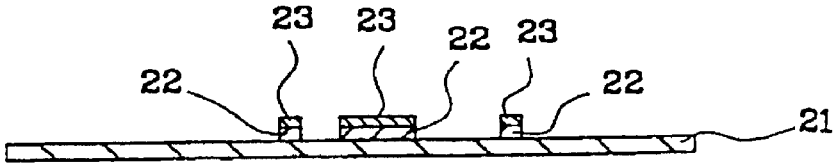
FIG. 2b (A–A)

FIG. 3b (B–B)

ANTENNA DEVICE AND A METHOD FOR MANUFACTURING AN ANTENNA DEVICE

TECHNICAL FIELD

The present invention relates to an antenna device according to the preamble of claim 1. The invention also relates to a method for manufacturing an antenna device according to the preamble of claim 12.

DESCRIPTION OF BACKGROUND ART

Common techniques in manufacturing of antenna elements includes either the use a thin self supportive metal sheet having a desired shape, or creating a radiating pattern in a metal coating, supported by a substrate, e.g. by etching, or applying a radiating pattern to a substrate, e.g. by screen printing conducting paint.

These types of antenna elements are usually flexible and may easily be mounted to a mobile telephone.

The metal sheet, or radiating pattern, normally used is made of copper or a copper alloy. The copper oxidises over time and normally there is a need to have a portion of the antenna element connected to some other equipment, e.g. a conductive connection. This connection portion may be plated with another metal to avoid the oxidation and to obtain a good contact with low contact resistance, by for instance gold. This is an expensive process, since gold is expensive.

In DD 146 873, there is described a device for improving the performance of an electrical switch by coating the copper with graphite. By adding the graphite coating the oxidation of the copper is prevented and a good contact between two adjacent circuits on a PCB may be achieved by using a push-button switch over the graphite coated adjacent circuits.

The present invention seeks to provide an improved antenna device.

SUMMARY OF THE INVENTION

According to an aspect of the present invention, there is provided an antenna device as specified in claim 1.

The invention is also directed to a method by which an embodiment of the desired antenna device is manufactured.

An advantage of having a graphite compound at least partially coating an antenna device in the present invention is that it prevents the coated conductive pattern to oxidise.

Another advantage of having the graphite coating in the present invention is that it provides a protective layer for the antenna element, since the graphite has sliding properties.

An advantage with an embodiment of the present invention is that the graphite compound provides a contact portion with a low contact resistance compared to without a graphite compound, since the graphite compound prevents the coated conductive pattern to oxidise and the soft graphite compound shapes it self around a contact device, e.g. a contact pin or waveguide shim.

Another advantage is that the inventive antenna device can be used in MID technology with decreased risk of oxidation of conductors.

Another advantage with a further embodiment of the present invention is that the soft graphite compound may be applied to a conductive pattern, which is arranged on a flexible substrate, which is to be bent.

An advantage with the manufacturing method is that the manufacturing steps are reduced when using the graphite compound as a film, where the graphite compound is applied in the shape of the conductive pattern.

BRIEF DESCRIPTION OF THE DRAWINGS

FIG. 1 shows a cross-section of an inventive antenna device.

FIG. 2*a* shows a top view of a first embodiment of the present invention.

FIG. 2*b* shows a cross section of the first embodiment along a line A—A in FIG. 2*a*.

FIG. 3*b* shows a cross section of the second embodiment along a line B—B in FIG. 3*a*.

DETAILED DESCRIPTION OF THE PREFERRED EMBODIMENTS

The present invention corresponds to graphite coating of surfaces to electrically conductive structures, especially for the following areas of mobile or hand held telecommunication devices:

1) External antennas (terminal antennas)

2) Built-in antennas

3) External antennas, satellite antennas.

4) External and internal antennas for vehicles

These antennas may have a two or three dimensional geometry. The antenna pattern (which is at least partially coated with graphite) may be applied on a flat or curved surface.

The conductive structure is coated at least partially with graphite, for instance through screen printing techniques. By doing this, contact points with high contact performance may be achieved without having to gold plate a part of the surface of the conductive structure.

Figure 3A:
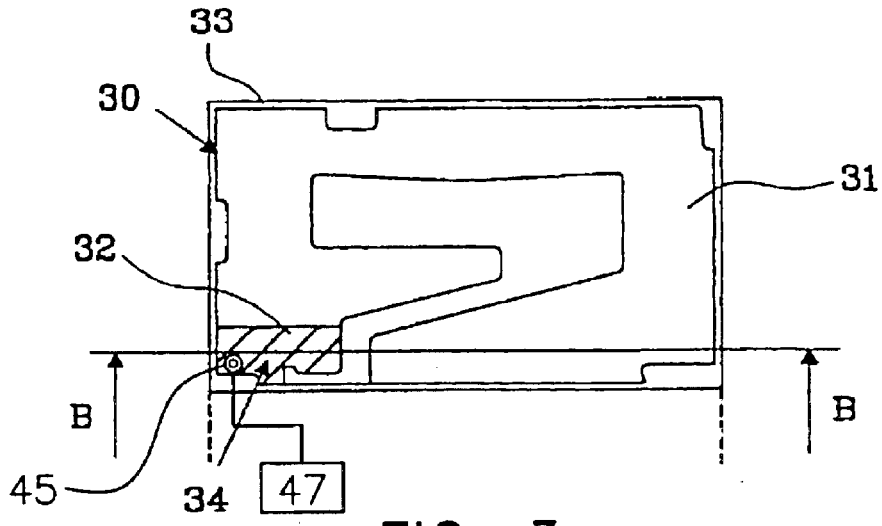
FIG. 3*a* shows a top view of a second embodiment of the present invention.
Figure 3C:
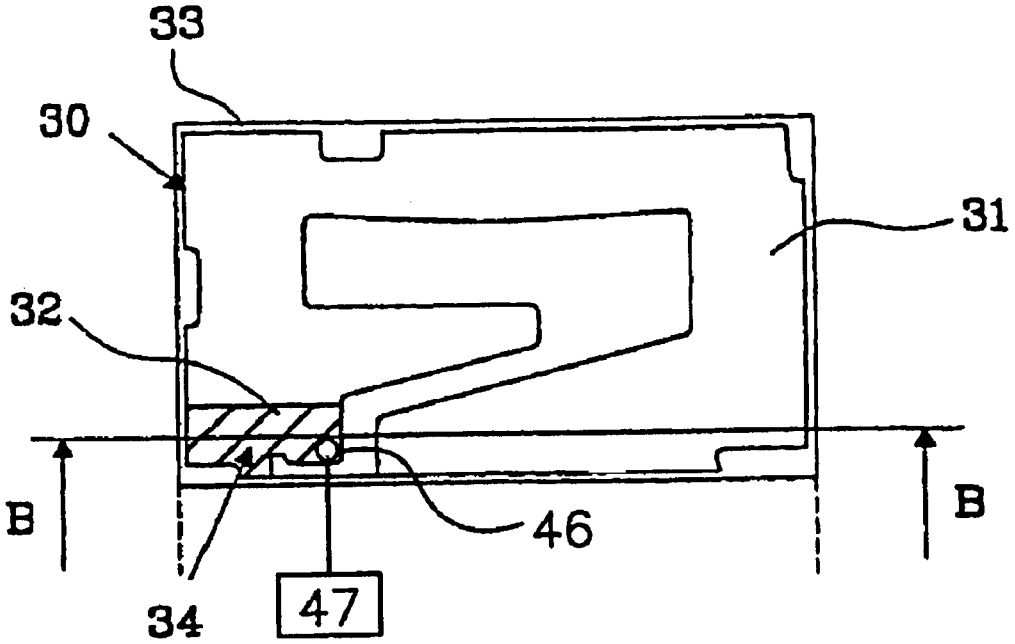
FIG. 3*c* shows a top view of a third embodiment of the present invention.
Figure 4A:
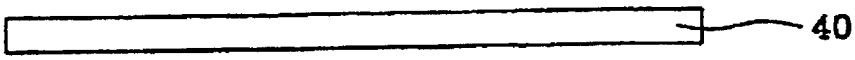
FIG. 4*a*–4*d* shows manufacturing steps for an embodiment of the present invention.
Figure 4B:
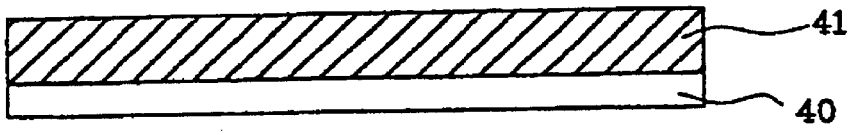
Figure 4C:
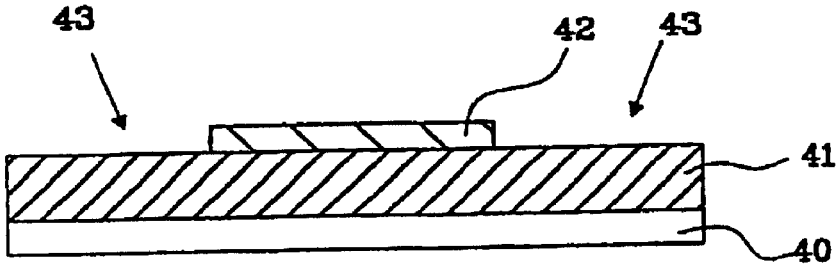
Figure 4D:
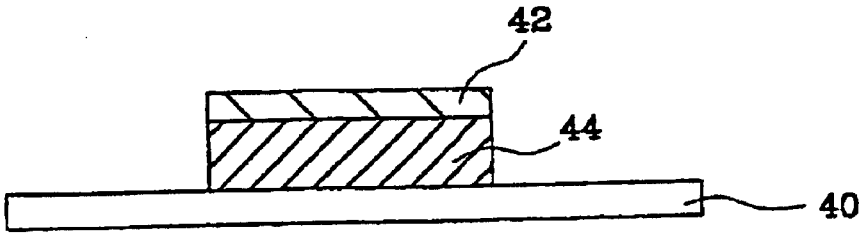

The graphite is a bit soft and can form it self after a contacting device, e.g. contact pin 45 or waveguide shim 46, which is provided to connect the antenna device to a transceiver circuit 47, as shown in FIG. 3*a* and FIG. 3*c*. Furthermore, good contact characteristics with other contact devices of different materials may be achieved.

The part of the conductive structure that is coated with graphite is also protected against oxidation, and that part is also protected against external damage (such as scratching or wearing) by the graphite itself and its lubricating (or sliding) properties.

Figure 5:
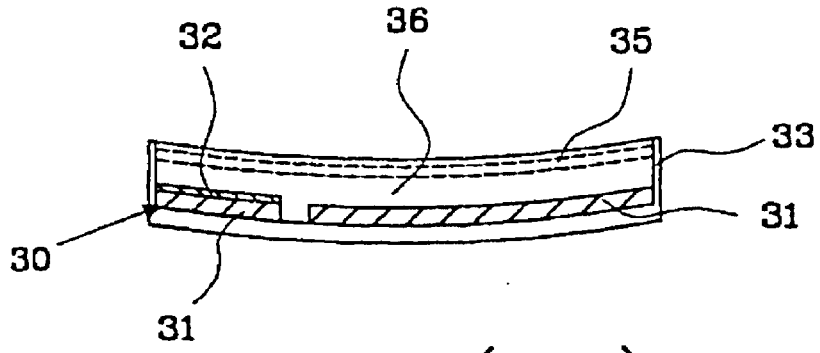
FIG. 5 shows an antenna device being mounted inside an antenna assembly.
Figure 5:
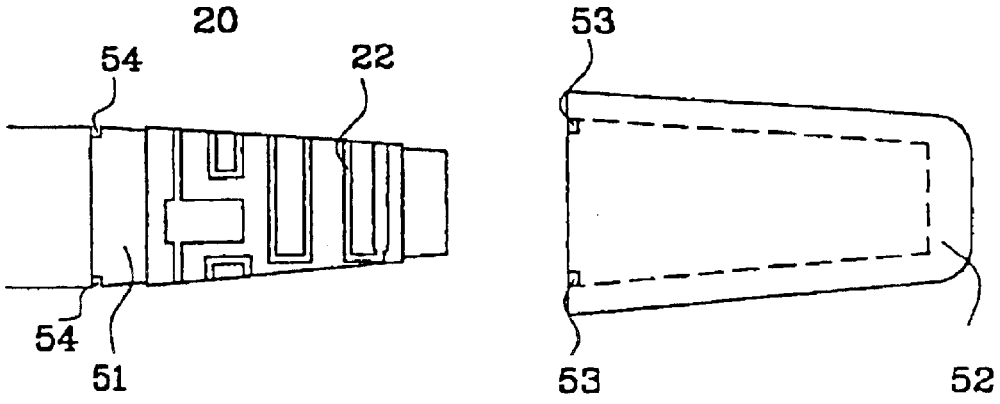

The protection against external damage may be useful when mounting an antenna device comprising a conductive structure covered with graphite, as illustrated in FIG. 5. There is also a need for having lubricating properties within the antenna device, since there may be some friction to the conductive pattern during normal use of a communication device having an antenna.

The following drawings are illustrating the invention.

FIG. 1 shows a cross-section of an inventive antenna device 10, comprising a substrate 11, on which a conductive structure 12, or pattern, is formed. A graphite coating 13 is arranged on top of the conductive pattern 12.

FIG. 2*a* shows a top view of an antenna device 20, comprising a substrate 21 and a conductive pattern 22 having a graphite coating arranged on top of the complete conductive pattern 22. The antenna device is provided with a contact portion 24. A cross section of the antenna device 20 is shown in FIG. 2*b*, where the substrate is denoted 21 and the conductive pattern is denoted 22. On top of the conductive pattern 22 is a graphite 23 coating arranged. A method for manufacturing this antenna device 20 is illustrated in FIGS. 4*a*–4*d*. The size of the illustrated antenna device 20 is larger than the actual size.

FIG. 3*a* shows an antenna device 30 mounted inside a telephone cover 33. Only the upper part of the cover is shown and the lower part is indicated by the dashed lines. The antenna device 30 comprises a metal sheet shaped into a conductive pattern 31 and a partial graphite coating 32, illustrated by the hatch pattern, which is arranged on a part of the conductive pattern 31 to form a contact area 34. A contact pin 45 (or waveguide shim 46, as shown in FIG. 3*c*) may easily be brought into contact with the conductive pattern 31 via said graphite coating 32.

The metal sheet containing the conductive pattern 31 is flexible and may be applied inside the telephone cover and follow the interior shape of the cover 33, i.e. a curved shape, as shown in FIG. 3*b*.

FIG. 3*b* is a cross section taken along the line B—B in FIG. 3*a* or FIG. 3*c*. The conductive pattern 31 of the antenna device 30 is bent to follow the shape of the cover 33. This way the antenna device takes minimum space. The graphite coating 32 is, in this example, only applied to the contact area 34 of the conductive pattern 31 of the antenna device 30. The antenna device in this example is a PIFA (Planar Inverted F-Antenna). A ground plane 35 is illustrated by dashed lines, which ground plane is separated from the antenna device 30. The space 36 between the ground plane 35 and the antenna device 30 may be filled with a dielectric material or by air.

A graphite coating may naturally be applied to the whole surface of the conductive pattern in the above described example. A such coating may provide a protection to the antenna from external damages in form of scratching or wearing.

Although the detailed description above only refers to a graphite coating, it is possible to use a graphite compound, having similar properties as pure graphite.

FIGS. 4*a*–4*d* illustrates a manufacturing method for the first embodiment shown in FIG. 2*a* and 2*b*.

The method starts by selecting a suitable substrate 40, the substrate could be a flexible self-adhesive plastic film, a PCB (Printed Circuit Board) or any other type of non-conductive material, flexible or rigid.

A suitable metal 41 having good conductibility, e.g. copper, copper alloy or silver polymer is then arranged to the substrate 40. These metals are relatively cheap and easy to use, but experience a major drawback since they have the inherent property of oxidising the surface of the metal.

After the metal 41 is arranged to the substrate 40, a film 42 is applied to the metal 41. The film 42 is made of graphite or a graphite compound and the film 42 may have a meandering shape as shown in FIG. 2*a*, or any other desired antenna shape, e.g. like the antenna shown in FIG. 3.

The uncovered metal 43, i.e. metal not covered by the film 42, is then removed by e.g. etching, using a medium reacting essentially with the metal coating not covered by the film. The result of this method is presented in FIG. 4*d* where the substrate 40 carries a conductive pattern 44 which is covered by a protective coating 42 made of graphite or a graphite compound.

Previous known techniques for manufacturing antenna devices comprises the first step of selecting a suitable substrate and arranging a metal coating on top of the substrate. The following step is to apply a film, which have the desired radiating pattern. The shape of the conductive pattern is thereafter obtained by removing the metal not covered by the film. Then, the film is removed from the conductive pattern and the antenna device is completed. After this step there may be additional coatings applied to contact portions to reduce the contact resistance between the conductive pattern and a contact device, which is connected to a transceiver circuit. Normally this coating is a gold plating.

These additional steps are avoided so that cheaper and easier manufacture of antenna devices is obtained.

FIG. 5 shows an antenna device 20 mounted on a conically shaped rod 51. The antenna device 20 may be attached using an adhesive material. The rod is thereafter inserted into a case 52 and the rod 51 is attached to the case 52 using snap fittings 53, 54. Due to the lubricating properties of the graphite, which cover the conductive pattern 22 of the antenna device 20, the rod (with the attached antenna device) is easily mounted without any frictionally damages. The antenna assemlby is thereafter mounted to a hand held telecommunication device, such as a mobile telephone.

What is claimed is:

1. An antenna device comprising a metal conductive pattern, said conductive pattern is provided with at least one contact portion, characterised in that said conductive pattern is at least partially coated with a film made of a graphite compound.

2. The antenna device according to claim 1, wherein said graphite compound film covers said contact portion adapted for contacting a contact device connected to a transceiver circuit.

3. The antenna device according to claim 2, wherein said contact device is a contact pin.

4. The antenna device according to claim 2, wherein said contact device is a waveguide shim.

5. The antenna device according to claim 1, wherein said conductive pattern is made of at least one material in a group consisting of: copper, copper alloy or silver polymer.

6. The antenna device according to claim 1, wherein said conductive pattern is provided on a substrate.

7. The antenna device according to claim 6, wherein said conductive pattern is at least partly a meander pattern.

8. The antenna device according to claim 6, wherein said conductive pattern is arranged on a curved substrate.

9. The antenna device according to claim 6, wherein said conductive pattern is arranged on a flat substrate.

10. The antenna device according to claim 9, wherein said antenna device is flexible.

11. The antenna device according to claim 9, wherein said graphite compound comprises essentially pure graphite.

12. A method for manufacturing an antenna device, said antenna device comprising a substrate carrying a metal conductive pattern, said method comprises the steps of:

arranging a metal coating on said substrate, applying a film on said metal coating, said film having the intended shape of the conductive pattern, characterised in that the method further comprises the steps of:

selecting the film to be made of a graphite compound, removing the metal coating not covered by the film, whereby a conductive metal pattern, having a graphite compound protection layer is created.

13. The method according to claim 12, wherein said graphite compound comprises essentially pure graphite.

14. The method according to claim 12, wherein said substrate is flexible.

* * * * *